US008573136B1

(12) United States Patent
Kokatsu et al.

(10) Patent No.: US 8,573,136 B1
(45) Date of Patent: Nov. 5, 2013

(54) LOADING STRUCTURE

(71) Applicant: Fuji Xerox Co., Ltd., Tokyo (JP)

(72) Inventors: Noritsugu Kokatsu, Kanagawa (JP); Tomomi Kobayashi, Kanagawa (JP); Kenji Ishizaka, Kanagawa (JP); Yasuhiro Minamidate, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/693,884

(22) Filed: Dec. 4, 2012

(51) Int. Cl.
*B65D 19/44* (2006.01)

(52) U.S. Cl.
USPC ..... 108/55.5; 108/55.1

(58) Field of Classification Search
USPC ..... 108/51.11, 57.12, 55.1, 55.5, 55.3; 248/346.02
See application file for complete search history.

(56) References Cited

U.S. PATENT DOCUMENTS

| | | | | |
|---|---|---|---|---|
| 3,523,507 | A * | 8/1970 | Dubin | 108/57.12 |
| 3,753,407 | A * | 8/1973 | Tilseth | 108/53.3 |
| 4,901,650 | A * | 2/1990 | Armstead | 108/55.1 |
| 5,287,816 | A * | 2/1994 | Jungpeter et al. | 108/55.1 |
| 5,676,066 | A * | 10/1997 | Cavalier et al. | 108/55.1 |
| 5,911,179 | A * | 6/1999 | Spiczka | 108/51.11 |
| 5,970,886 | A * | 10/1999 | Knio | 108/57.12 |
| 6,418,867 | B1 * | 7/2002 | Erickson | 426/805 |
| 6,422,405 | B1 * | 7/2002 | Haenszel | 108/55.1 |
| 6,463,863 | B1 * | 10/2002 | Ishikawa et al. | 108/53.1 |
| 7,654,390 | B2 * | 2/2010 | Baechle et al. | 108/55.1 |
| 7,658,285 | B2 * | 2/2010 | Hagan et al. | 108/55.5 |
| 7,712,421 | B2 * | 5/2010 | Hartel et al. | 108/56.3 |
| 7,997,213 | B1 * | 8/2011 | Gauthier et al. | 108/55.1 |
| 8,172,194 | B2 * | 5/2012 | Cummins et al. | 108/57.12 |
| 8,327,775 | B2 * | 12/2012 | Fox Harris | 108/53.3 |
| 2005/0188901 | A1 * | 9/2005 | Arai et al. | 108/53.1 |
| 2009/0000983 | A1 * | 1/2009 | Kiolbasa | 108/55.5 |

FOREIGN PATENT DOCUMENTS

| | | | |
|---|---|---|---|
| JP | 06-156499 | A | 6/1994 |

* cited by examiner

*Primary Examiner* — Jose V Chen
(74) *Attorney, Agent, or Firm* — Sughrue Mion, PLLC

(57) ABSTRACT

A loading structure includes a bottom plate; a support stand; a pair of first poles; a pair of second poles; a first beam connecting the pair of the second poles to each other; a pair of second beams each connecting a corresponding one of the first poles to a corresponding one of the second poles; and a supporting member supporting a far-side surface of the object placed on the bottom plate. The support stand includes a first support, an upright portion, and a second supporter, the first supporter being placed on the floor and extending parallel to the floor, the upright portion standing at an end portion of the first supporter, the second supporter extending parallel to the floor from an upper end portion of the upright portion, the second supporter having a cantilever structure, and the bottom plate being placed on the second supporter.

5 Claims, 11 Drawing Sheets

LOADING STRUCTURE

CROSS-REFERENCE TO RELATED APPLICATIONS

This application is based on and claims priority under 35 USC 119 from Japanese Patent Application No. 2012-098332 filed Apr. 24, 2012.

BACKGROUND

Technical Field

The present invention relates to loading structures.

SUMMARY

A loading structure according to an aspect of the invention includes a bottom plate on which an object is placed; a support stand that supports the bottom plate from below the bottom plate the bottom plate so as to lift the bottom plate above the floor; a pair of first poles that stand individually at a left portion and a right portion on a near side of the loading structure; a pair of second poles that stand individually at a left portion and a right portion on a far side of the loading structure; a first beam located on the far side and extending in a left-right direction, the first beam connecting the pair of the second poles to each other; a pair of second beams individually located on a right side and a left side and extending from the near side to the far side, each of the second beams connecting a corresponding one of the first poles to a corresponding one of the second poles; and a supporting member that stands at such a far-side position as not protrude toward the far side beyond the pair of second poles, the supporting member supporting a far-side surface of the object placed on the bottom plate. The support stand includes a first support, an upright portion, and a second supporter, the first supporter being placed on the floor and extending parallel to the floor, the upright portion standing at an end portion of the first supporter, the second supporter extending parallel to the floor from an upper end portion of the upright portion, the second supporter having a cantilever structure, and the bottom plate being placed on the second supporter. The pair of first poles and the pair of second poles stand while having lower end portions of the first poles and the second poles supported by the first supporter or the upright portion of the support stand. The supporting member stands on the second supporter of the support stand while being supported by the second supporter.

BRIEF DESCRIPTION OF THE DRAWINGS

An exemplary embodiment of the present invention will be described in detail based on the following figures, wherein:

FIG. 4A is a side view of the belt and FIG. 4B is a plan view of the belt;

DETAILED DESCRIPTION

Figure 1:
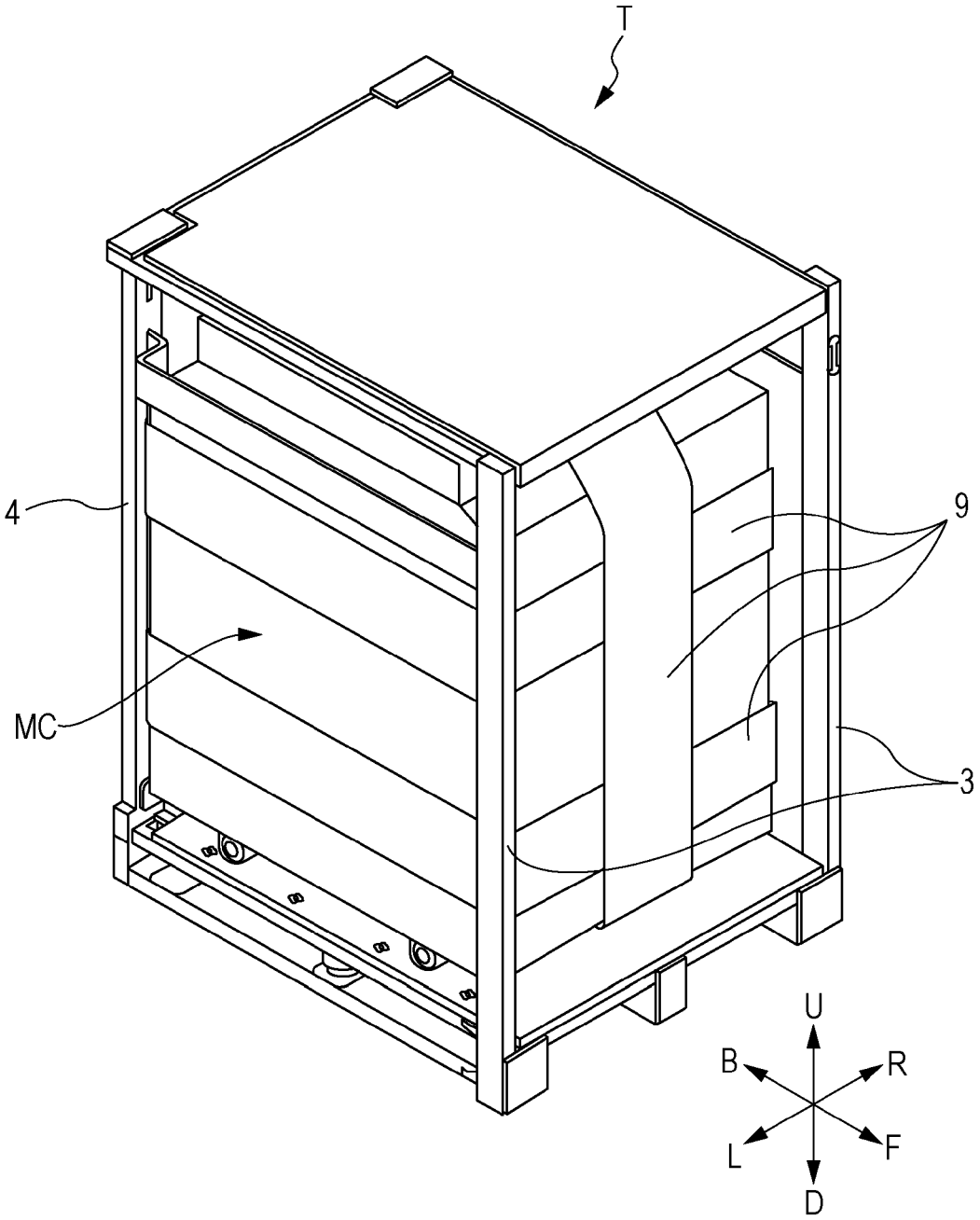
FIG. 1 is a perspective view of a transportation rack, which is a loading structure according to an exemplary embodiment of the present invention.

Referring to the drawings, an exemplary embodiment of the present invention will be described below.

FIG. 1 is a perspective view of a transportation rack T, which is a loading structure according to the exemplary embodiment of the present invention.

The transportation rack T illustrated in FIG. 1 serves both as a transportation rack used when an object MC is transported in a container or the like and as a storage rack used when an object MC is stored in a warehouse or the like. Typically, the object MC placed on the transportation rack T is an industrial product. For example, the object MC is an office machine such as a copying machine, a printer, or a fax machine. The object MC is placed on or removed from the transportation rack T through the right side of transportation rack T illustrated in FIG. 1. Here, the side of the transportation rack T through which the object MC is placed and removed is referred so as a near side F, and the side opposite the front side F is referred to as a far side B. The directions from/to the near side F and to/from the far side B are also collectively referred to as a front-back direction FB. When seen from the near side F of the transportation rack T, the sides on the right and left of the transportation rack T are referred to as a right side R and a left side L. The directions from/to the left side L and to/from the right side R are also collectively referred to as a left-right direction LR. The side of the transportation rack T facing the floor is referred to as a lower side D and the side of the transportation rack T facing vertically upward is referred to as an upper side U. The directions from/to the upper side U and to/from the lower side D are also collectively referred to as an up-down direction UD.

The transportation rack T is a reusable rack. After the transportation rack T containing the object MC is transported to its destination, the object MC is removed from the transportation rack T without the transportation rack T being disassembled. The transportation rack T from which the object MC is removed is then returned to the origin (a production plant or warehouse of the object MC, for example), and is used to transport another object.

The transportation rack T has a structure that allows, while containing the object MC, another transportation rack having the same structure to be stacked thereon. Multiple transportation racks T are stacked on top of one another in accordance with the capacity of the storage space, such as a container or a warehouse. The transportation rack T includes four poles 3 and 4 positioned so as to surround the object MC. When multiple transportation racks T are stacked on top of one another, the poles 3 and 4 of one of the transportation racks T support the load of other transportation racks (T) stacked thereon. The object MC is fixed to the transportation rack T with belts 9, but not to the poles 3 and 4.

Figure 2:
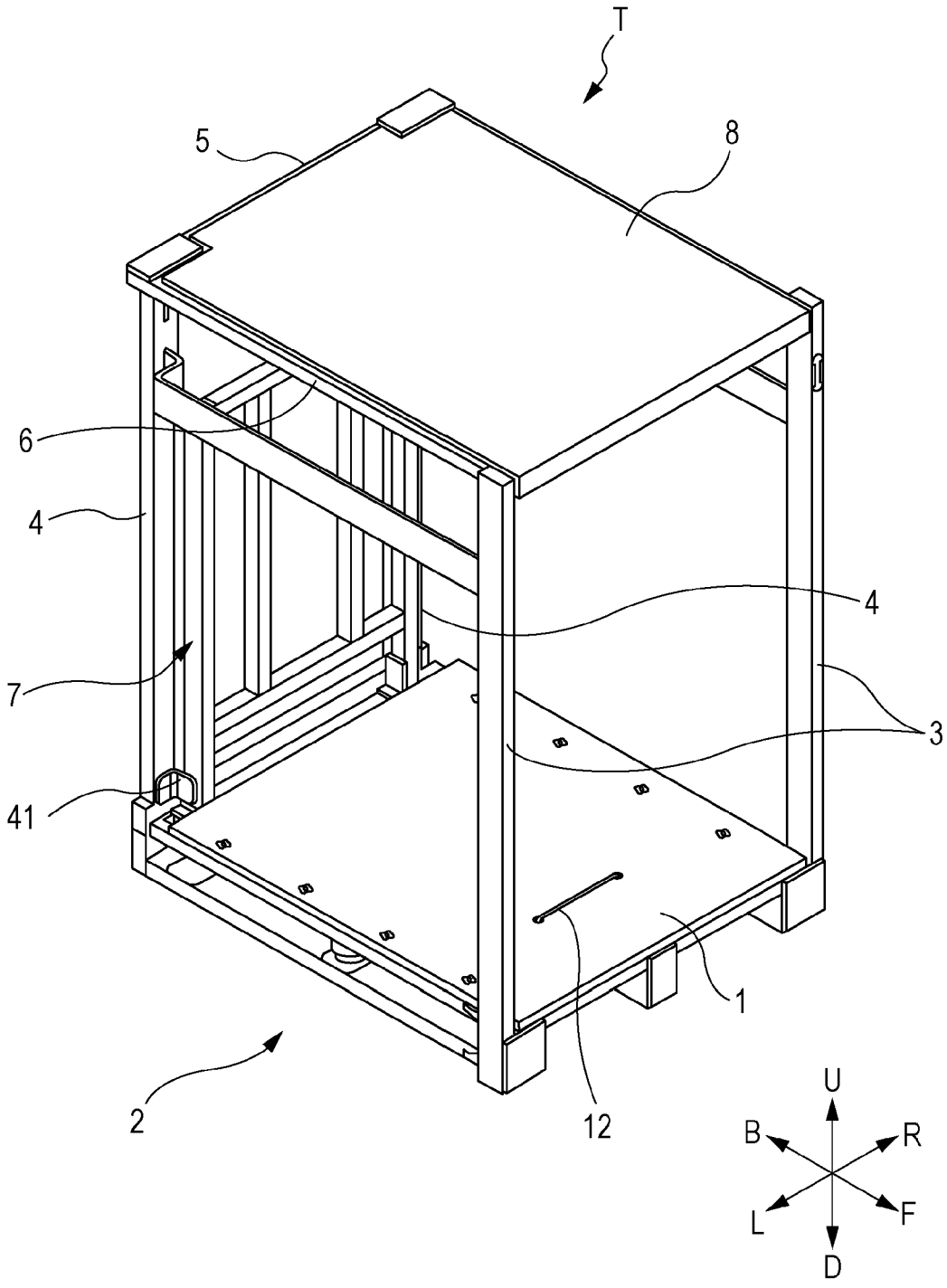
FIG. 2 is a perspective view of the transportation rack from which an object is removed.

FIG. 2 is a perspective view of the transportation rack T from which the object MC is removed.

The transportation rack T includes a bottom plate 1, a support stand 2, front poles 3, back poles 4, a back beam 5, side beams 6, a back frame 7, a top plate 8, and belts 9. FIG. 2 illustrates the transportation rack T from which the belts 9 (see FIG. 3) are removed.

Here, the front poles 3 are examples of first poles of the present invention, and the back poles 4 are examples of second poles of the present invention. The back beam 5 is an example of a first beam of the present invention, and the side beams 6 are examples of second beams of the present invention. The back frame 7 is an example of a supporting member of the present invention, and the belts 9 (see FIG. 1) are examples of a band member of the present invention.

The bottom plate 1 is a component on which the object MC (see FIG. 1) is placed. The bottom plate 1 is a generally rectangular flat plate made of wood, for example. A rod-shaped buckle 12 is attached to the bottom plate 1 to fasten an end portion of one of the belts 9 (see FIG. 1).

The support stand 2 supports the bottom plate 1 from below the bottom plate 1 so that the bottom plate 1 is lifted above the floor. The support stand 2 has a space into or from which a fork of a hand lift truck or a forklift truck, which is not illustrated, is inserted or removed. A fork is insertable into or removable from the support stand 2 from either the near side F, the far side B, the left side L, or the right side R.

The back frame 7 is a component that supports a far-side-B surface of the object MC (see FIG. 1) placed on the bottom plate 1. The back frame 7 stands on the support stand 2 on the far side B.

The top plate 8 is a component that, when the object MC (see FIG. 1) is contained in the transportation rack T when the transportation rack T is in use, covers the object MC from above to protect the object MC from any falling object or other sources of danger. The top plate 8 is a generally rectangular flat plate member made of resin, for example. The top plate 8 is mounted on the side beams 6. When the transportation rack T is not in use, the top plate 8 is removed from the side beams 6 and placed on the bottom plate 1.

Figure 3:
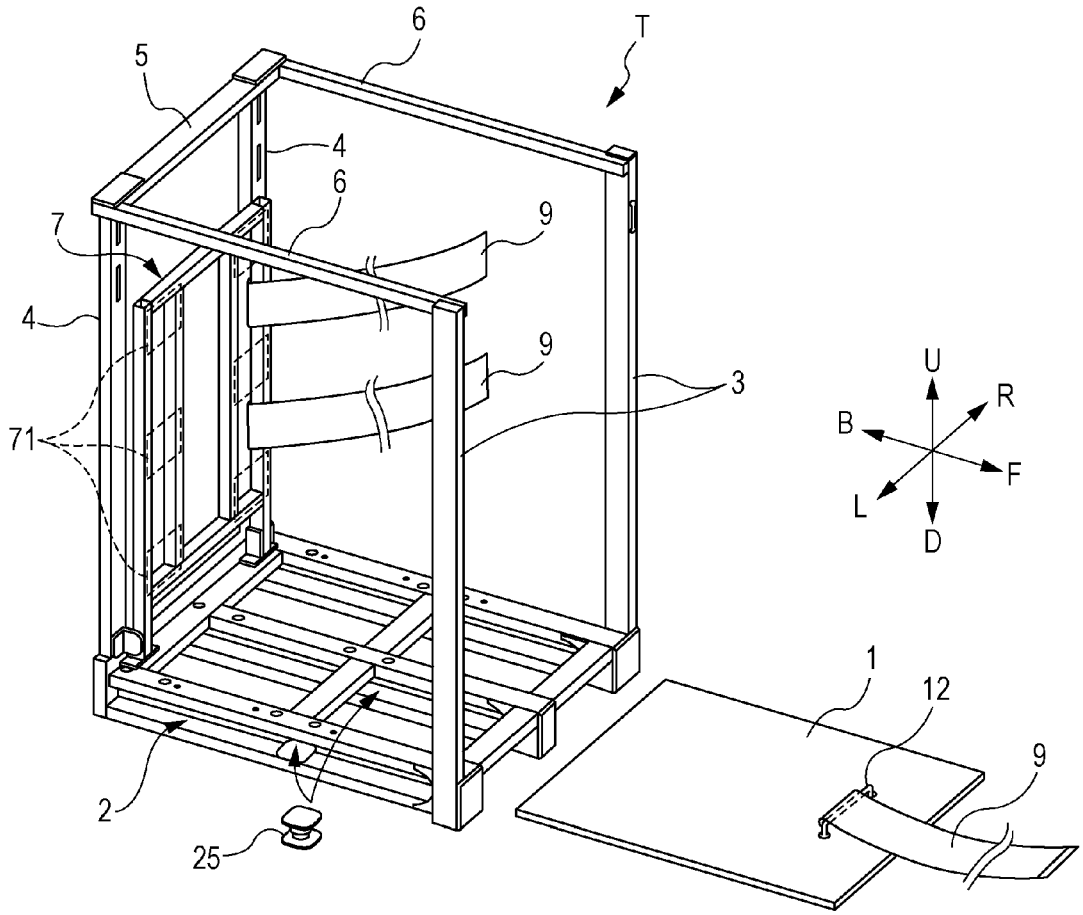
FIG. 3 is a perspective view of the transportation rack illustrated in FIG. 2 from which a bottom plate and a top plate are removed.

FIG. 3 is a perspective view of the transportation rack T illustrated in FIG. 2 from which the bottom plate 1 and the top plate 8 are removed.

The bottom plate 1 is fixed to the support stand 2. Although the bottom plate 1 is continuously joined to an upper portion of the support stand 2 with screw threads regardless of whether the transportation rack T is in use or not, FIG. 3 and the following drawings illustrate the state where the bottom plate 1 is removed for visibility of the structure. Cushioning members 71 are attached to the back frame 7 so as to be interposed between the back frame 7 and the object MC. The cushioning members 71 are polyurethane foam pads, for example. The cushioning members 71 prevent the object MC from being damaged as a result of the object MC coming into contact with the back frame 7. The cushioning members 71 also reduce transmission of impacts. For visibility of the structure of the back frame 7, however, the positions of the cushioning members 71 are merely illustrated by broken lines in FIG. 3.

Vibration-isolation rubber pieces 25, serving as shock absorbers, are mounted on the support stand 2 according to the exemplary embodiment to assist the support stand 2 in supporting the load of the object MC. The vibration-isolation rubber pieces 25 are attached to or detached from the transportation rack T depending on the weight of the object MC contained in the transportation rack T. The positions at which the vibration-isolation rubber pieces 25 are disposed may be changed depending on the weight and the form of the object MC. Examples of the material of the shock absorbers include materials other than rubber, such as a polyurethane foam. The vibration-isolation rubber pieces 25 will be described in detail below.

FIG. 3 illustrates three belts 9 attached to the transportation rack T. One of the three belts 9 is attached to the buckle 12 of the bottom plate 1. As illustrated in FIG. 1, when the transportation rack T is in use, the belt 9 attached to the bottom plate 1 extends from the bottom of the object MC over the front and upper surfaces of the object MC to the outer side (back side) of the back frame 7 (FIG. 3) to so as to be wound around the object MC. Ends of the remaining two belts 9 are attached to the back frame 7. As illustrated in FIG. 1, when the transportation rack T is in use, the belts 9 extend from the back side of the object MC over the right, front, and left surfaces of the object MC so as to be wound around the object MC.

Figure 4A:
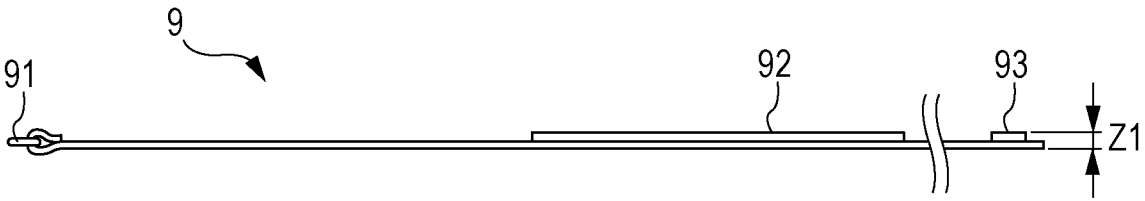
FIGS. 4A and 4B illustrate a structure of a belt, where
Figure 4B:
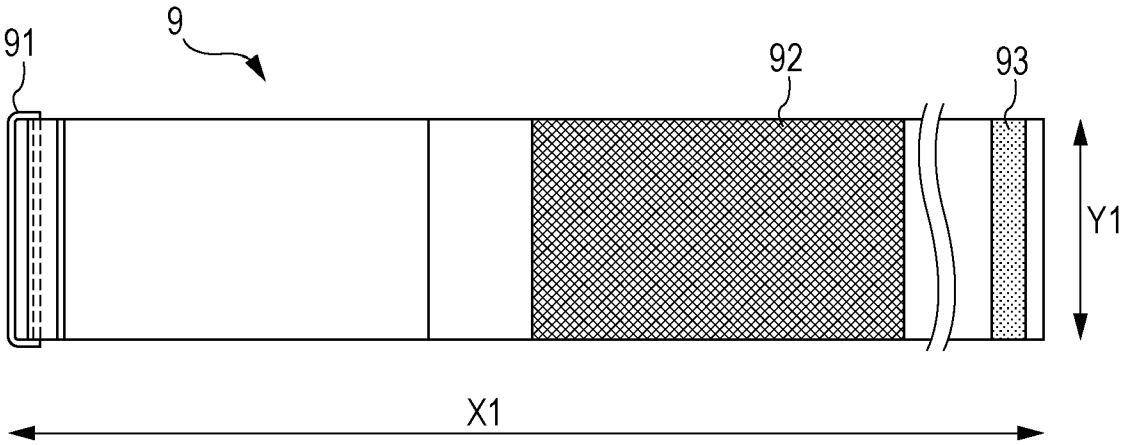

FIGS. 4A and 4B illustrate the structure of each belt 9. FIG. 4A is a side view of the belt 9, and FIG. 4B is a plan view of the belt 9.

The three belts 9 have the same shape and size. The most part of each belt 9 is made of cloth, and a ring buckle 91 is attached to an end of each of the belts 9. Loops 92 of a hook-and-loop fastener and hooks 93 of the hook-and-loop fastener are disposed on one surface of each belt 9 with a gap therebetween. The full length X1 of each belt 9 is longer than the outer periphery (one round) of the object MC that is placeable on the transportation rack T. The full length X1 of the belt 9 is sufficiently large to deal with the size of, for example, a large printer, and is approximately 2,680 mm, for example. The width Y1 of the belt 9 is approximately 200 mm. As illustrated in FIG. 1, the belts 9 wound around the object MC are folded back at their buckles 91 (see FIG. 4) and when the loops 92 and the hooks 93 are joined to one another, the object MC is fastened and fixed to the back frame 7 and the support stand 2 with the belts 9. The thickness Z1 of the thickest part of each belt 9, at which the loops 92 and the hooks 93 are disposed, is approximately 5 mm.

Figure 5:
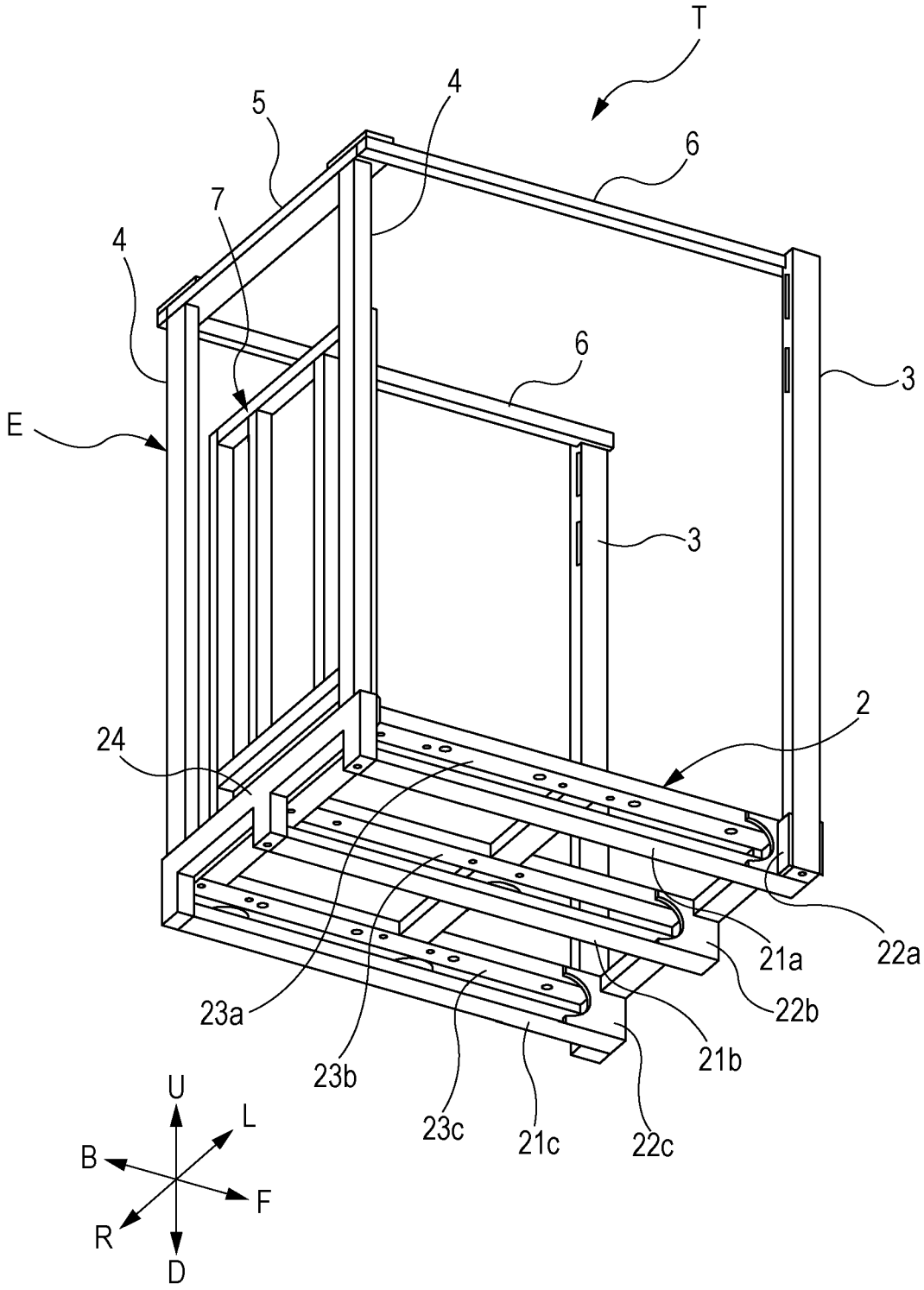
FIG. 5 is a perspective view of the transportation rack when viewed from behind and below.
Figure 6:
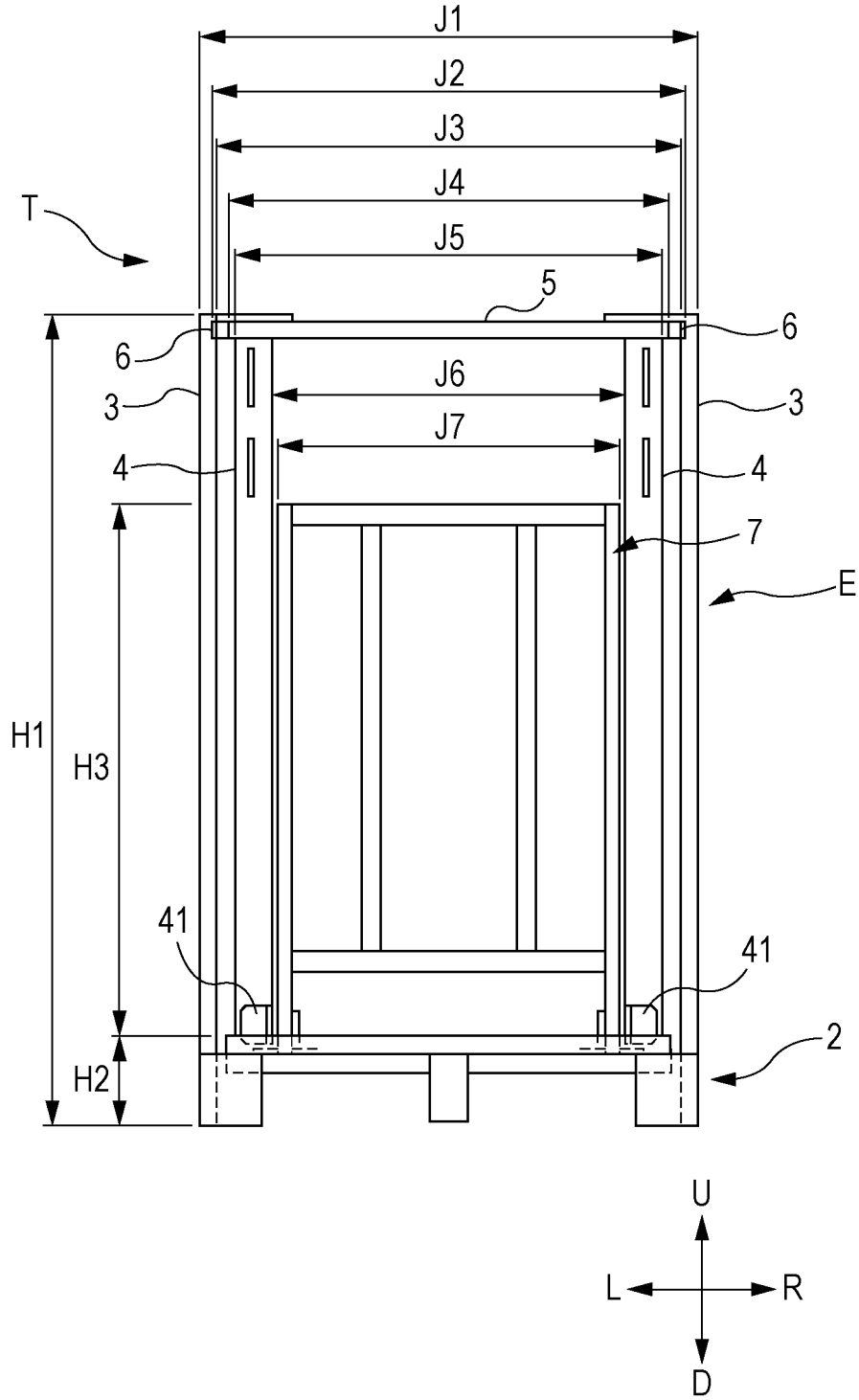
FIG. 6 is a front view of the transportation rack.
Figure 7:
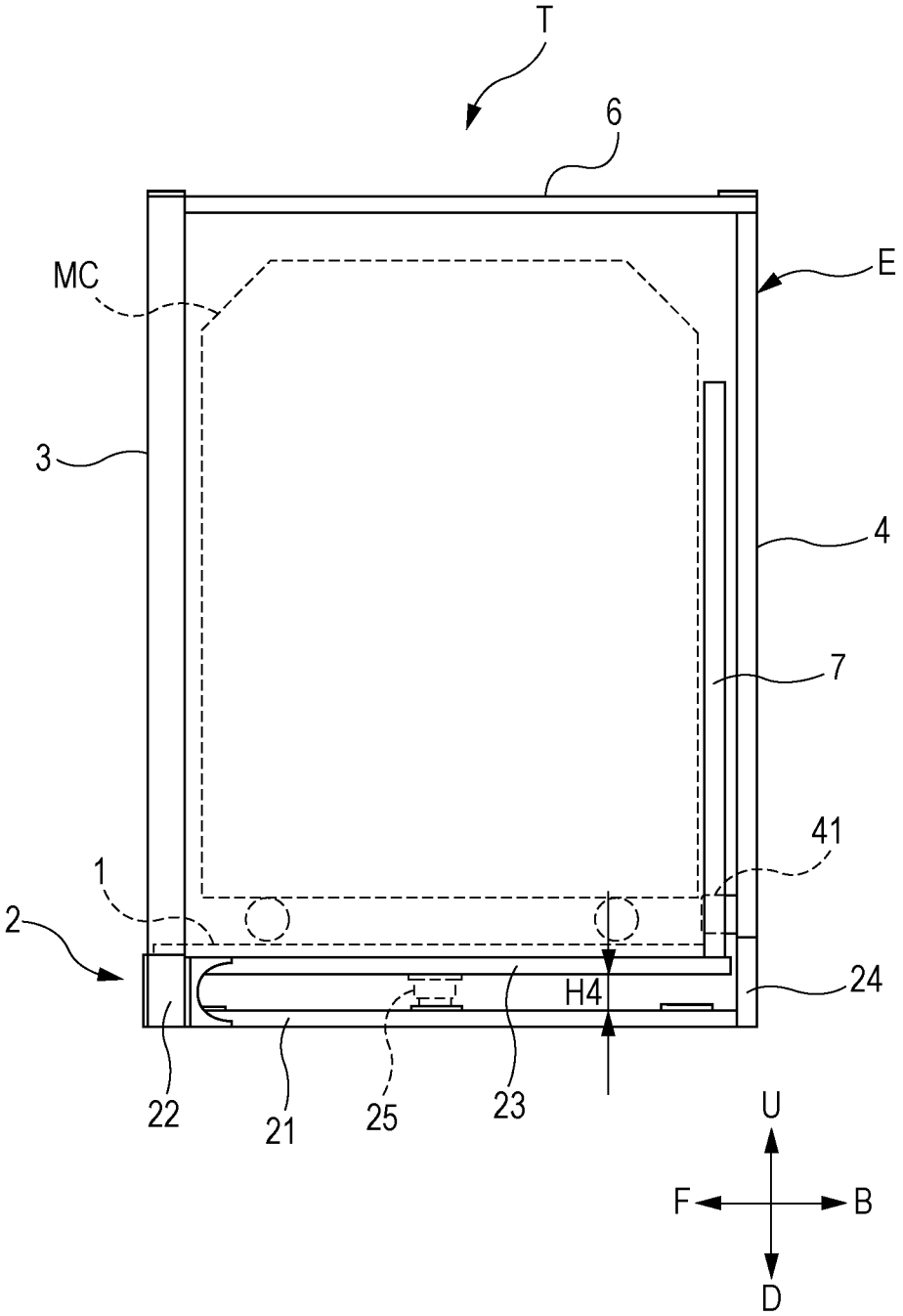
FIG. 7 is a right side view of the transportation rack.
Figure 8:
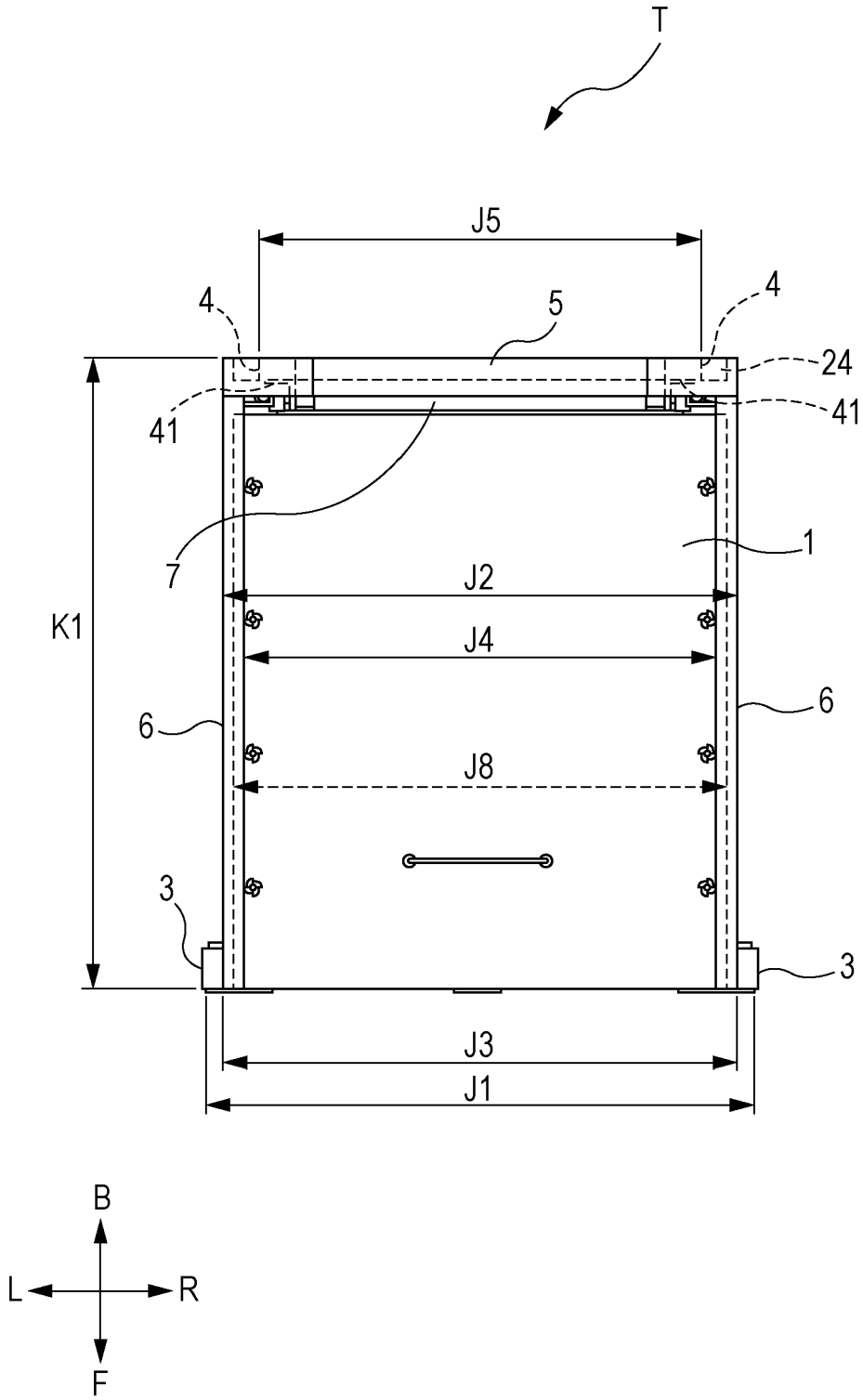
FIG. 8 is a plan view of the transportation rack.

FIG. 5 is a perspective view of the transportation rack T when viewed from behind and below. FIG. 6 is a front view of the transportation rack T. FIG. 7 is a right side view of the transportation rack T. FIG. 8 is a plan view of the transportation rack T. For visibility of the structure, FIGS. 5 to 8 illustrate the transportation rack T from which the top plate 8 and the belts 9 are removed. FIGS. 5 and 6 illustrate the transportation rack T from which the bottom plate 1 is also removed. FIG. 7 illustrates the object MC and the bottom plate 1 with broken lines.

Referring to FIGS. 3 and 5 to 8, the structure of the transportation rack T will be described further. The support stand 2, the front poles 3, the back poles 4, the back beam 5, the side beams 6, and the back frame 7 of the transportation rack T are formed out of stick-shaped objects made of metal such as iron. More specifically, these components are formed by joining iron pipes together by welding or by other ways.

Structures of Support Stand and Back Frame

The structures of the support stand 2 and the back frame 7 are described now. The support stand 2 includes three first supporters 21 (21*a*, 21*b*, and 21*c*), three upright portions 22 (22*a*, 22*b*, and 22*c*), and three second supporters 23 (23*a*, 23*b*, and 23*c*). Firstly, the first supporter 21*a*, the upright portion 22*a*, and the second supporter 23*a*, which constitute a left-side-L section of the support stand 2, will be described. The first supporter 21*a* is placed on the floor (not illustrated) on which the transportation rack T is disposed and extends parallel to the floor from the far side B to the near side F. The upright portion 22*a* is fixed to a near-side-F end portion of the first supporter 21*a* and stands at the end portion of the first supporter 21*a*. A near-side-F end portion of the second supporter 23*a* is fixed to an upper end portion of the upright portion 22*a*, and the second supporter 23*a* extends from the upper end portion of the upright portion 22*a* parallel to the floor from the near side F to the far side B. The bottom plate 1 is fixed to an upper portion of the second supporter 23*a*. The first supporter 21*a*, the upright portion 22*a*, and the second supporter 23*a* are arranged so as to collectively form a lying U shape. The second supporter 23*a* is a cantilever supported by the upper end portion of the upright portion 22*a*. The first supporter 21*c*, the upright portion 22*c*, and the second supporter 23*c* constitute a right-side-R section of the support stand 2 which has the same configuration as the left-side section. The first supporter 21*b*, the upright portion 22*b*, and the second supporter 23*b* constitute a middle section of the support stand 2 located between the left side L and the right side R, the middle section having the same configuration as the left-side section.

A pair of front poles 3 stand on the support stand 2 on the left side L and right side R on the near side F by being supported by the support stand 2. A pair of back poles 4 stand on the support stand 2 on the left side L and right side R on the far side B by being supported by the support stand 2. More specifically, among the pair of front poles 3, the left-side-L front pole 3 has a lower-side-D end portion fixed to the upright portion 22*a* and to a near-side-F end portion of the left-side-L first supporter 21*a*. The right-side-R front pole 3 has a lower-side-D end portion fixed to the upright portion 22*c* and to a near-side-F end portion of the right-side-R first supporter 21*c*.

A girder 24 that stands upright toward the upper side U is attached to far-side-B end portions of the three first supporters 21*a*, 21*b*, and 21*c* including the left and right first supporters 21*a* and 21*c*. The girder 24 connects the far-side-B end portions of the first supporters 21*a*, 21*b*, and 21*c* together. The girder 24 is disposed closer to the far side B than the bottom plate 1 is. The uppermost point of the standing girder 24 is above the bottom plate 1. Lower ends of the pair of back poles 4 are fixed to upper portions of the girder 24. Hereinbelow, the components forming the left, right, and middle sections of the support stand 2 are commonly referred to as the first supporters 21, the upright portions 22, and the second supporters 23.

The back frame 7 is fixed to far-side-B end portions of the second supporters 23*a*, 23*b*, and 23*c*, and substantially vertically stands at the end portions. The back frame 7 includes multiple pipes that are fixed to one another and arranged so as to form a flat plane that intersects substantially perpendicularly to the front-back direction FB.

As illustrated in FIG. 7, the second supporters 23 of the support stand 2 support the object MC with the bottom plate 1 interposed therebetween, and the back frame 7 supports the object MC with the cushioning members 71 (see FIG. 3) interposed therebetween. The object MC is held on the second supporters 23 and the back frame 7 by using the belts 9. The second supporters 23 and the back frame 7 function as a cantilever that is supported by the upper end portions of the upright portions 22. The back frame 7 is supported by the support stand 2. With this structure, when the transportation rack T receives an external force, such as an impact, the first supporters 21, the upright portions 22, and the second supporters 23 of the support stand 2 are elastically deformed and the second supporters 23 and the back frame 7 holding the object MC move independently of the first supporters 21 on the floor. More specifically, the second supporters 23 and the back frame 7 move so as to rotate in the up-down direction UD and the left-right direction LR within limited angle ranges about the upright portions 22. In the transportation rack T according to the exemplary embodiment, an external impact is absorbed by the elastic deformation of the first supporters 21, the upright portions 22, and the second supporters 23. Thus, the transportation rack T transmits less impact to the object MC than in the case of the transportation rack T not having the cantilever structure. Consequently, the transportation rack T is also usable in, for example, container transportation of the object MC.

The impact is also absorbed by elastic deformation of the first supporters 21, the upright portions 22, and the second supporters 23, which are made of metal. Since metals have a larger modulus of elasticity than rubber materials, the second supporters 23 and the back frame 7 of the transportation rack T (and hence the object MC) are moved (or displaced) a smaller distance than in the case where the transportation rack T only has, for example, rubber-made shock absorbers. Particularly, an excessive movement (displacement) in the left-right direction LR is less likely to occur than in the case where the shock absorbers made of rubber, for example, are used instead.

Vibration-isolation rubber pieces 25 (see FIG. 7) are interposed between the first supporters 21 and the second supporters 23. The vibration-isolation rubber pieces 25 supplementally support the load of the object MC or the load in the up-down direction UD. The transportation rack T is more likely to prevent excessive deformation and vibrations of the first supporters 21, the upright portions 22, and the second supporters 23 than in the case where the transportation rack T does not include the vibration-isolation rubber pieces 25.

A pair of vibration dampers 41 are disposed on the left side L and the right side R of the back frame 7. Each vibration damper 41 is formed by bending a metal plate in the L shape, and is disposed so as to face a left or right outer surface of the back frame 7 with a gap between itself and the outer surface. The vibration dampers 41 are individually fixed to the back poles 4. The vibration dampers 41 suppress left-right LR vibrations of the far-side-B end portions of the second supporters 23. This prevents the back frame 7 and the second supporters 23 from coming into contact with external objects due to excessive vibrations or prevents the support stand 2 from being deformed.

In the transportation rack T according to the exemplary embodiment, the upright portions 22 are disposed on the near side F of the support stand 2 and the near-side-F end portions of the first and second supporters 21 and 23 are fixed to the upright portions 22. In other words, the cantilever including the second supporters 23 is supported by the upright portions 22 disposed on the near side F of the transportation rack T. When the object MC is placed on or removed from the transportation rack T, the vertical position (orientation) of the second supporters 23 changes in accordance with the change in weight of the object MC. Here, the height of the second supporters 23 from the floor on the near side F changes to a smaller extent than that on the far side B since the cantilever including the second supporters 23 is supported on the near side F of the transportation rack T. Consequently, the height of the bottom plate 1 on the near side F, through which the object MC is placed on or removed from the transportation rack T, changes to a smaller extent than in the case where the cantilever is supported on the far side B, the left side L, or the right side R. This facilitates the placing and removing of the object MC on and from the transportation rack T. Depending on the weight of the object MC that is contained in the transportation rack T, the second supporters 23 on the far side B moves downward a larger distance than those on the near side F. Thus, the load of the object MC is more likely to act on the far side B, on which the back frame 7 is disposed and which is opposite the near side F through which the object MC is placed and removed. Consequently, the object MC is more stably placed than in the case where the cantilever is supported on the far side B, the left side L, or the right side R.

Structure of Pillars and Beams

A structure of an outer frame of the transportation rack T will be described.

In the transportation rack T, the front poles 3 and the back poles 4 are disposed at positions corresponding to the four corners of the object MC (see FIG. 1) and the back beam 5 and the side beams 6 are disposed above the object MC. The front poles 3, the back poles 4, the side beams 6, the back beam 5, the first supporters 21, and the girder 24 constitute an outer frame structure E, which forms the contour of the transportation rack T.

The pair of front poles 3 are disposed individually at left and right portions on the near side F of the support stand 2 and extend straight in the up-down direction UD. The pair of front poles 3 stand by being supported by the first supporters 21 and the upright portions 22 of the support stand 2.

The pair of back poles 4 are disposed individually at left and right portions on the far side B of the support stand 2 and extend straight in the up-down direction UD. The pair of back poles 4 stand by being supported by the first supporters 21 via the girder 24 of the support stand 2. More specifically, the back poles 4 stand on the girder 24 that stands at the far-side-B ends of the first supporters 21.

The back beam 5 is disposed on the far side B and extends in the left-right direction LR. The back beam 5 connects the pair of back poles 4 to each other. The back beam 5 is fixed to upper portions of the pair of back poles 4. Both ends of the back beam 5 protrude in the left-right direction LR beyond the pair of back poles 4.

Front end portions of the side beams 6 are fixed to upper portions of the front poles 3 and the side beams 6 extend toward the far side B. Back end portions of the side beams 6 are individually fixed to left and right ends of the back beam 5. Thus, the side beams 6 are fixed to the back poles 4 via the left and right ends of the back beam 5.

Dimensional Relationship

Figure 9:
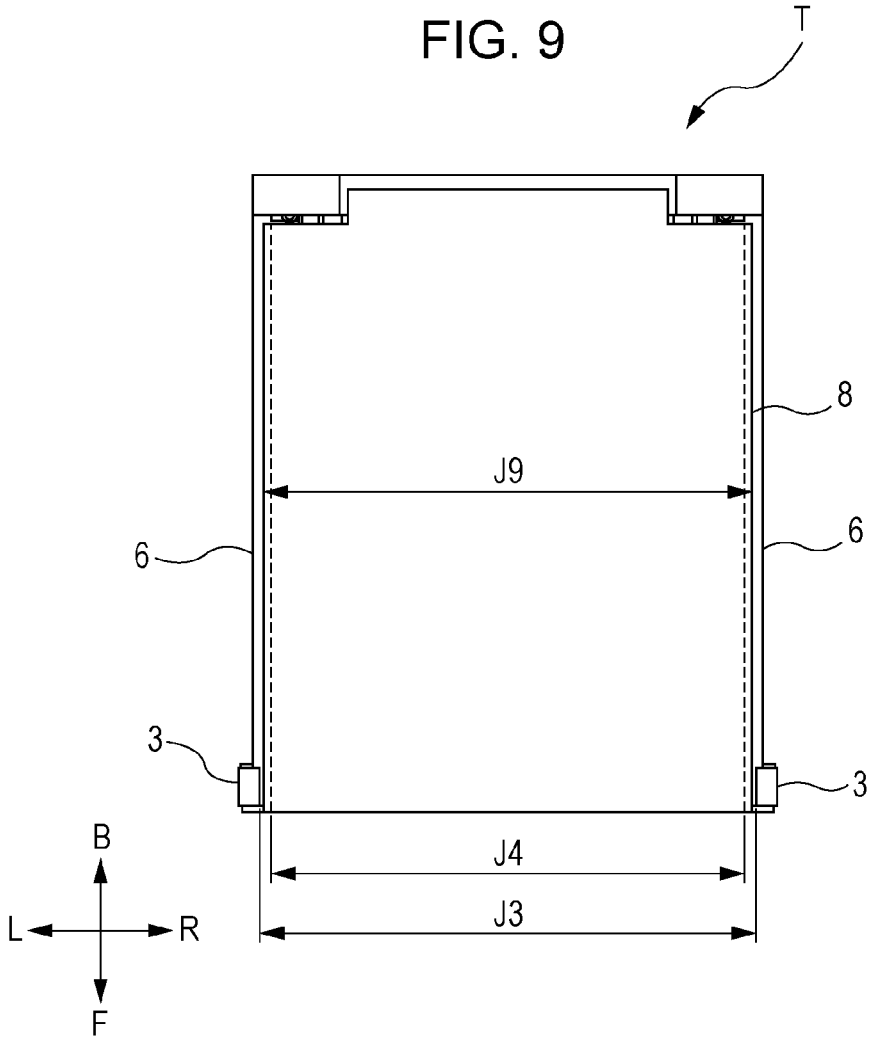
FIG. 9 is a plan view of the transportation rack on which the top plate is mounted.

The dimensions of each part of the transportation rack T will be described now. FIGS. 6 and 8 show dimension lines indicating the dimensions of each part. FIG. 9 is a plan view of the transportation rack T on which the top plate 8 is mounted. In the drawings, J1 denotes a distance between outer surfaces of the pair of front poles 3 in the left-right direction LR, J2 denotes a distance between outer surfaces of the pair of side beams 6 in the left-right direction LR, J3 denotes a distance between inner surfaces of the pair of front poles 3 in the left-right direction LR, J4 denotes a distance between inner surfaces of the pair of side beams 6 in the left-right direction LR, J5 denotes a distance between outer surfaces of the pair of back poles 4 in the left-right direction LR, J6 denotes a distance between inner surfaces of the pair of back poles 4 in the left-right direction LR, J7 denotes an outside dimension of the back frame 7 in the left-right direction LR, J8 (see FIG. 8) denotes the width of the bottom plate 1 in the left-right direction LR, and J9 (see FIG. 9) denotes the width of the top plate 8 in the left-right direction LR.

The pair of back poles 4 of the transportation rack T according to the exemplary embodiment are positioned further inward than the pair of front poles 3 when seen from the front, as illustrated in FIG. 6. In other words, the distance J5 between the outer surfaces of the pair of back poles 4 is smaller than the distance J3 between the inner surfaces of the pair of front poles 3. Moreover, the distance J4 between the inner surfaces of the pair of side beams 6 is larger than the distance J5 between the outer surfaces of the pair of back poles 4 but smaller than the distance J3 between the inner surfaces of the pair of front poles.

The dimension of the girder 24 in the left-right direction LR is smaller than the distance J3 between the inner surfaces of the pair of front poles 3. The width J8 of the bottom plate 1 in the left-right direction LR is substantially equal to the dimension of the girder 24 in the left-right direction LR. Thus, the width J8 of the bottom plate 1 is smaller than the distance J3 between the inner surfaces of the pair of front poles 3. The back frame 7 has the outside dimension J7 in the left-right direction LR, which is smaller than the distance J5 between the outer surfaces of the pair of back poles 4. In addition, the back frame 7 is disposed so as not to protrude beyond the pair of back poles 4 in the left-right direction LR and toward the far side B.

Specifically, in the transportation rack T according to the exemplary embodiment, the relationship J1>J2>J3>J4>J5>J6>J7 is satisfied.

FIG. 8 illustrates the transportation rack T when viewed from above. In FIG. 8, the left and right edges of the bottom plate 1 of the transportation rack T are indicated by broken lines behind the side beams 6. The bottom plate 1 has the width J8 in the left-right direction LR, which is smaller than the outside dimension of the outer frame structure E of the transportation rack T excluding the bottom plate 1 when the transportation rack T is viewed from the above. The bottom plate 1 is disposed so as not to protrude beyond the outer frame structure E in the left-right direction LR. The front poles 3 included in the outer frame structure E are disposed at left and right portions on the near side F of the bottom plate 1. The width J8 of the bottom plate 1 is smaller than the distance J1 between the outer surfaces of the pair of front poles 3. The girder 24 included in the outer frame structure E is disposed closer to the far side B than the bottom plate 1 is. The width J8 of the bottom plate 1 is substantially equal to the dimension of the girder 24 in the left-right direction 24. In other words, the width J8 of the bottom plate 1 is smaller than the distance J3 between the inner surfaces of the pair of front poles 3.

The width J9 (see FIG. 9) of the top plate 8 in the left-right direction LR is smaller than the distance J2 between the outer surfaces of the pair of side beams 6 but larger than the distance J4 between the inner surfaces of the pair of side beams 6. The width J9 of the top plate 8 is smaller than the distance J3 between the inner surfaces of the pair of front poles 3.

The distance J1 between the outer surfaces of the pair of front poles 3 according to the exemplary embodiment is largest in the transportation rack T in the left-right direction LR. Preferably, the distance J1 between the outer surfaces of the pair of front poles 3 ranges from approximately 700 mm to approximately 800 mm, inclusive.

When the distance J1 between the outer surfaces of the pair of front poles 3 is approximately 700 mm or larger and the dimension of each front pole 3 in the left-right direction is approximately 30 mm, the transportation rack T is capable of containing a printer having a width below approximately 640 mm. The most widely used containers in marine transportation are 40-foot containers (regular containers). The inside dimensions of a 40-foot container are approximately 12 m in length, 2.34 m in width, and 2.34 m in height. If the maximum dimension of the transportation rack T in the left-right direction LR is approximately 800 mm or smaller, the distance J2 between the outer surfaces of the pair of side beams 6 is approximately 760 mm. Thus, three transportation racks T are containable side by side in a row in a 40-foot container having the width of approximately 2.34 m. Here, three times the maximum dimension of 800 mm is 2.4 m, which exceeds the width of the container. However, the arranging of three transportation racks T side by side in a row is enabled by shifting one of the transportation racks T in the front-back direction FB so that the three pairs of front poles 3 are not aligned with one another, the distance between the outer surfaces of each pair of front poles 3 being maximum of the transportation rack T in the left-right direction LR. The above arrangement, however, involves restrictions on the order in which transportation racks T should be loaded or unloaded into or from the container owing to one of the three transportation racks T arranged side by side in a row in the container having been shifted in the front-back direction FB. Here, the restrictions are avoided if the distance J1 between the outer surfaces of the pair of front poles 3, i.e., the maximum dimension of the transportation rack T, is 770 mm or lower.

A transportation rack T having a height not exceeding 2.34 m is containable in the container. If having a height not exceeding 1.1 m, two transportation racks T are capable of being stacked one on top of the other.

Examples of the dimensions of the parts of the transportation rack T according to the exemplary embodiment will be shown below, but are not limited to these examples.

The distance J1 between the outer surfaces of the pair of front poles 3: 800 mm The distance J2 between the outer surfaces of the pair of side beams 6: 760 mm The distance J3 between the inner surfaces of the pair of front poles 3: 740 mm The distance J4 between the inner surfaces of the pair of side beams 6: 700 mm The distance J5 between the outer surfaces of the pair of back poles 4: 690 mm The distance J6 between the inner surfaces of the pair of back poles 4: 570 mm The outside dimension J7 of the back frame 7: 560 mm The width J8 of the bottom plate 1 in the left-right direction LR: 720 mm The width J9 of the top plate 8 in the left-right direction LR: 720 mm The dimension of each front pole 3 in the left-right direction LR is 30 mm, and the dimension of each back pole 4 in the left-right direction LR is 60 mm. In addition, examples of the dimensions in the up-down direction UD and in the front-back direction FB are shown below.

The full height H1: 1,320 mm

The height H2 from the floor to the upper surface of the bottom plate 1: 133 mm The height H3 from the upper surface of the bottom plate 1 to the uppermost point of the back frame 7: 900 mm The gap H4 between each first supporter 21 and the corresponding second supporter 23 of the support stand 2 (when carrying no object MC, see FIG. 7): 55 mm The full length K1: 950 mm In the transportation rack T according to the exemplary embodiment, the front poles 3 and the back poles 4 extend in the up-down direction UD. Thus, when a different transportation rack T having the same structure is stacked on top of the transportation rack T, the transportation rack T supports the different transportation rack T from below. Consequently, multiple transportation racks T on each of which an object MC is placed are capable of being stacked on top of one another in accordance with the capacity of a storage space.

The object MC fixed to both the bottom plate 1 and the back frame 7 is supported by the second supporters 23 forming the cantilever structure. Thus, the object MC moves independently of the front poles 3, the back poles 4, the back beam 5, the side beams 6, and the first supporters 21, which constitute the outer frame structure E. Thus, the transportation rack T transmits less external impact to the object MC than in the case of the transportation rack T not having the cantilever structure.

When the transportation rack T is viewed from above, the bottom plate 1 on which the object MC is placed has the dimension J8 in the left-right direction LR that is shorter than the outside dimension of the outer frame structure E of the transportation rack T excluding the bottom plate 1. The bottom plate 1 is placed so as not to protrude beyond the outer frame structure E in the left-right direction LR. In case the transportation rack T having the above structure hits against an external object, the bottom plate 1 is prevented from being directly hit by the external object. The back frame 7 to which the object MC is fixed has the outside dimension J7 in the left-right direction LR that is smaller than the distance J5 between the outer surfaces of the pair of back poles 4, and the back frame 7 is disposed so as not to protrude beyond the pair of back poles 4 either in the left-right direction LR nor toward the far side B. Consequently, the back frame 7 is prevented from being directly hit by an external object.

Unoccupied Transportation Rack

An unoccupied transportation rack T from which an object MC has been removed at the destination is returned to the origin for reuse or stored somewhere else. In such a case, the top plate 8 of the transportation rack T is removed from the side beams 6 and placed on the bottom plate 1 to be contained in the transportation rack T.

The width J9 (FIG. 9) of the top plate 8 in the left-right direction LR is larger than the distance J4 between the inner surfaces of the pair of side beams 6 but smaller than the distance J3 between the inner surfaces of the pair of front poles 3. Consequently, when the transportation rack T is in use, the top plate 8 is mounted on the pair of side beams 6. When the transportation rack T is not in use, the top plate 8 is mounted on the bottom plate 1 by being inserted into the transportation rack T through the space between the pair of front poles 3 from the near side F.

The belts 9 are wound around the back frame 7 for storage.

Figure 10:
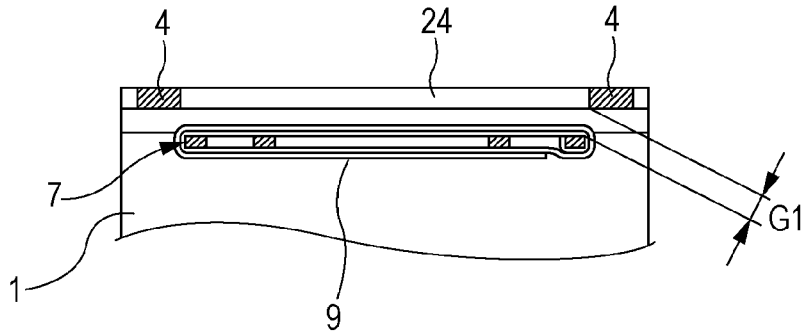
FIG. 10 is a cross sectional view of a back frame around which a belt is wound.

FIG. 10 is a cross sectional view of the back frame 7 around which a belt 9 is wound.

The belt 9 is wound around the back frame 7 multiple times. The back frame 7 stands so as to have a gap G1 between itself and each of the back poles 4. The gaps G1 have such a size as to accommodate the belt 9 wound around the back frame 7. When, for example, the outside dimension J7 (see FIG. 6) of the back frame 7 is approximately 560 mm and the full length X1 (see FIG. 4) of the belt 9 is approximately 2,680 mm, the belt 9 is wound around the back frame 7 so as to form almost three turns. When the thickness Z1 (see FIG. 4) of a thickest portion of the belt 9 is approximately 5 mm, the largest thickness of the three overlapping layers of the belt 9 is approximately 15 mm. Thus, the gaps G1 that are approximately 20 mm or more are capable of accommodating the belt 9 that is wound around the back frame 7. The gaps G1 that are approximately 25 mm or more are capable of accommodating the belt 9 with sufficient room left. The gaps G1 that are approximately 30 mm or less allow the outside dimension J7 of the back frame 7 to become large enough to support the object MC.

To transport multiple unoccupied transportation racks T collectively, the multiple transportation racks T are stacked on top of one another in a nesting manner. Specifically, a first transportation rack T is inserted into a second transportation rack T having the same structure. When a first transportation rack T is inserted into a second transportation rack T, the support stand 2 of the first transportation rack T is mounted on the bottom plate 1 of the second transportation rack T (more specifically, on the top plate 8 disposed on the bottom plate 1 of the second transportation rack T). That is, the first transportation rack T is lifted up to a position above the bottom plate and the top plate 8 mounted on the support stand 2 of the second transportation rack T and is inserted into the second transportation rack T from the near side F to the far side B. Multiple transportation racks T are stacked on top of one another while having the belts 9 wound around the corresponding back frames 7.

Figure 11:
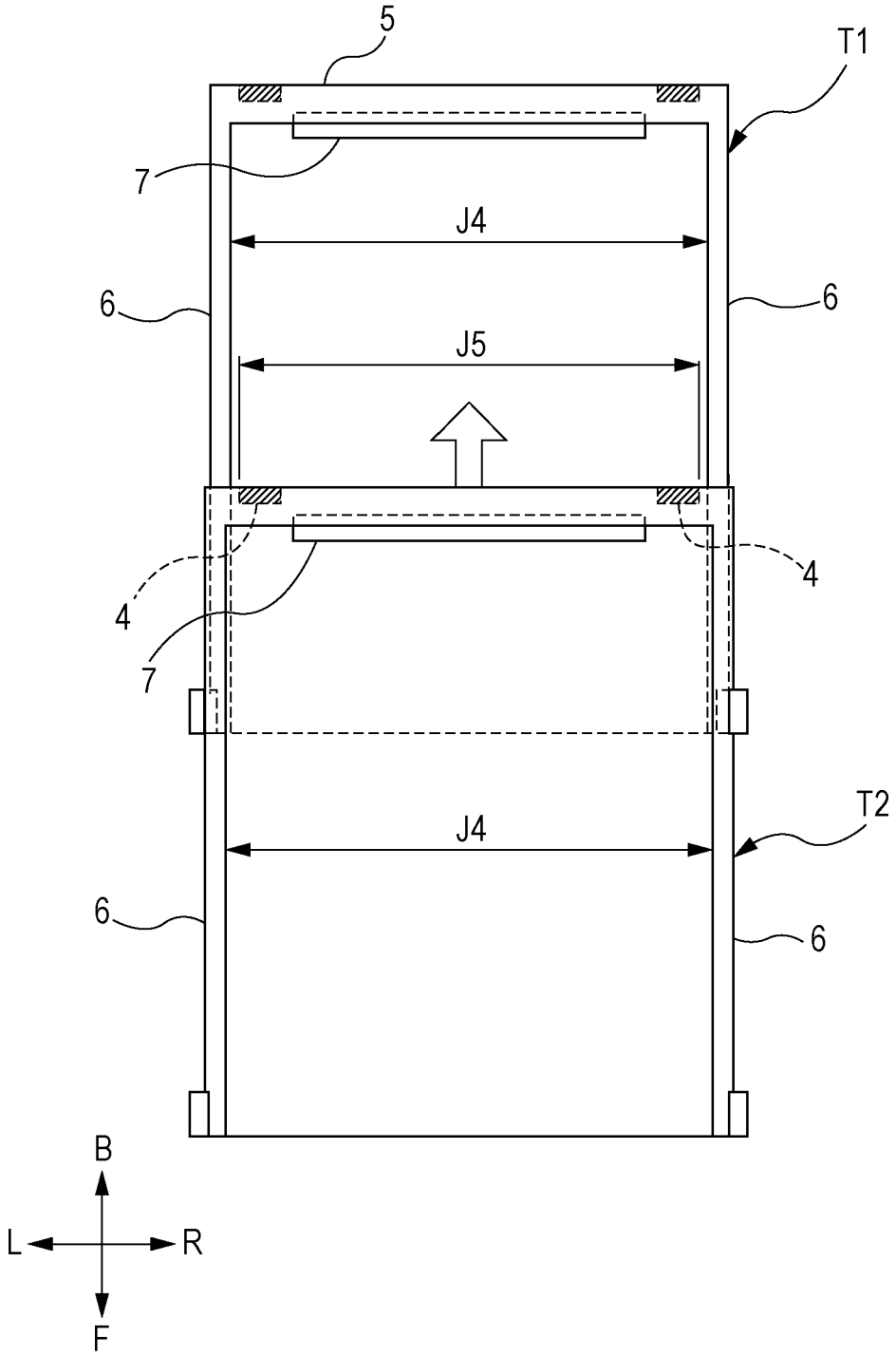
FIG. 11 is a plan view illustrating a process of inserting a transportation rack into another transportation rack.

FIG. 11 is a plan view for illustrating the process of inserting one transportation rack into another. FIG. 11 illustrates two transportation racks T1 and T2. The transportation racks T1 and T2 have the same structure described in the exemplary embodiment and have the same orientation. FIG. 11 illustrates the process of lifting the transportation rack T2 on the lower side of FIG. 11 and inserting the transportation rack T2 into the transportation rack T1 on the upper side of FIG. 11.

In each of the transportation racks T1 and T2, the distance between the outer surfaces of the pair of back poles 4 in the left-right direction LR is smaller than the distance between the inner surfaces of the pair of side beams 6 in the left-right direction LR. Thus, the pair of back poles 4 of the transportation rack T2 on the lower side of FIG. 11 move through the space between the pair of side beams 6 of the transportation rack T1 on the upper side of FIG. 11 toward the far side B of the transportation rack T1 on the upper side of FIG. 11. In each of the transportation racks T (T1 and T2) according to the exemplary embodiment, the back frame 7 stands on the support stand 2 (see FIG. 3) on the far side B. Thus, the back frame 7 of the transportation rack T1 on the upper side of FIG. 11 does not prevent the transportation rack T2 on the lower side of FIG. 11 from being inserted into the transportation rack T1. Consequently, the transportation racks T (T1 and T2) are capable of being stacked on top of one another in a nesting manner.

Figure 12:
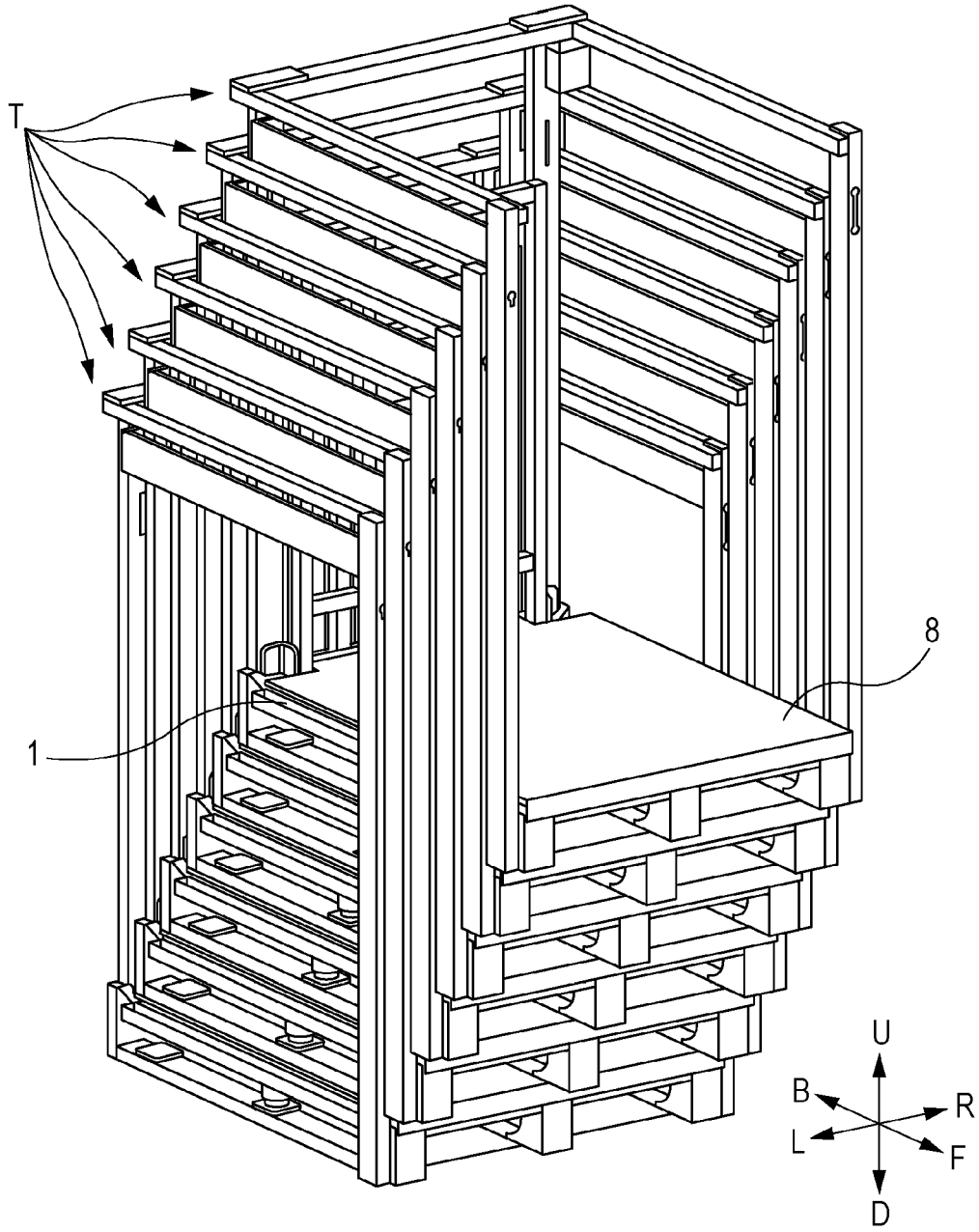
FIG. 12 is a perspective view of six transportation racks stacked on top of one another in a nesting manner.

FIG. 12 is a perspective view illustrating six transportation racks stacked on top of one another in a nesting manner.

Multiple transportation racks T are stackable on top of one another in a nesting manner as illustrated in FIG. 12. When the transportation racks T are to be returned after use, the transportation racks T are stored in a smaller storage space than the space that the transportation racks T occupy when being used for transportation of objects MC. The transportation rack T functions as a transportation rack and as a storage rack. Moreover, the transportation rack T occupies a smaller storage space when returned after use. This reduces transportation and storage costs. As illustrated in FIG. 12, multiple transportation racks T are stacked on top of one another while the top plates 8 are individually disposed on the bottom plates 1.

Although FIG. 12 illustrates an example in which six transportation racks are stacked, any feasible number of transportation racks may be stacked on top of one another in a nesting manner.

In the exemplary embodiment, the back beam 5 having both ends protruding beyond the pair of back poles 4 in the left-right direction LR is described as an example of a first beam of the present invention, and the pair of side beams 6 individually fixed to the pair of back poles 4 via the left and right ends of the back beam 5 are described as examples of a pair of second beams of the present invention. The present invention, however, is not limited to these examples, and the pair of second beams may be directly fixed to the pair of back poles 4.

In the exemplary embodiment, the back frame 7 formed by combining pipes is described as an example of a supporting member of the present invention. The present invention, however, is not limited to this example, and may be made of a board, for example.

In the exemplary embodiment, the belts 9 made of cloth and having a hook-and-loop fastener are described as examples of a band member of the present invention. The present invention, however, is not limited to this example. Examples of the band member include a rubber band and a band having a hook instead of the hook-and-loop fastener. The width of the band member does not have to be as large as the width of a band, and may be as small as the width of a string.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A loading structure comprising:

a bottom plate on which an object is placed;

a support stand that supports the bottom plate from below the bottom plate so as to lift the bottom plate above the floor;

a pair of first poles that stand individually at a left portion and a right portion on a near side of the loading structure;

a pair of second poles that stand individually at a left portion and a right portion on a far side of the loading structure;

a first beam located on the far side and extending in a left-right direction, the first beam connecting the pair of the second poles to each other;

a pair of second beams individually located on a right side and a left side and extending from the near side to the far side, each of the second beams connecting a corresponding one of the first poles to a corresponding one of the second poles; and a supporting member that stands at such a far-side position as not protrude toward the far side beyond the pair of second poles, the supporting member extending substantially orthogonal to the bottom plate and supporting a far-side surface of the object placed on the bottom plate, wherein the support stand includes a first supporter, an upright portion, and a second supporter, the first supporter being placed on the floor and extending parallel to the floor, the upright portion standing at an end portion of the first supporter, the second supporter extending parallel to the floor from an upper end portion of the upright portion, the second supporter having a cantilever structure supported by the upper end portion of the upright portion, and the bottom plate being placed on the second supporter, wherein the pair of first poles and the pair of second poles stand while having lower end portions of the first poles and the second poles supported by the first supporter or the upright portion of the support stand, and wherein the supporting member stands on the second supporter of the support stand while being supported by the second supporter.

2. The loading structure according to claim 1, wherein the supporting stand has a configuration in which the first supporter extends from the far side to the near side, the upright portion stands at a near-side end portion of the first supporter, and the second supporter extends toward the far side while having a near-side end portion of the second supporter supported by an upper portion of the upright portion, and wherein the supporting member stands by being supported by a far-side end portion of the second supporter.

3. The loading structure according to claim 2, comprising a shock absorber interposed between the first supporter and the second supporter.

4. The loading structure according to claim 3, comprising a pair of left and right vibration dampers individually fixed to the second poles and facing left and right outer surfaces of the supporting member with gaps therebetween, the vibrations dampers suppressing left and right vibrations of the far-side end portion of the second supporter.

5. The loading structure according to claim 2, comprising a pair of left and right vibration dampers individually fixed to the second poles and facing left and right outer surfaces of the supporting member with gaps therebetween, the vibrations dampers suppressing left and right vibrations of the far-side end portion of the second supporter.

* * * * *